United States Patent [19]

Forsmark et al.

[11] Patent Number: 4,815,997

[45] Date of Patent: Mar. 28, 1989

[54] SET OF ICE PRODS

[75] Inventors: Martin Forsmark, Trangsund; Per Wedlin, Solna, both of Sweden

[73] Assignee: Nya Bat & Maskinkapell HB, Stockholm, Sweden

[21] Appl. No.: 186,591

[22] Filed: Apr. 27, 1988

[30] Foreign Application Priority Data

Apr. 30, 1987 [SE] Sweden ..... 8701803

[51] Int. Cl.[4] ..... B63C 9/32

[52] U.S. Cl. ..... 441/82; 30/164.5; 224/232; 294/26

[58] Field of Search ..... 441/82; 30/164.5, 164.8; 224/232; 294/26

[56] References Cited

U.S. PATENT DOCUMENTS 4,002,366 1/1977 Hammes ..... 441/82 X
4,020,551 5/1977 Lindqvist ..... 294/26 X

FOREIGN PATENT DOCUMENTS 3159 3/1891 Sweden .
24918 12/1906 Sweden .
50724 3/1921 Sweden .
7501129 11/1978 Sweden .
7608020 6/1983 Sweden .

*Primary Examiner*—Sherman D. Basinger
*Attorney, Agent, or Firm*—Collard, Roe & Galgano

[57] ABSTRACT

An ice prod set comprises two ice prods, each of which comprises a handgrip having attached to one end thereof a metal spike which extends coaxially with the handgrip and each of which prods is held detachably in a two-part prod holder. A first safety line extends between respective parts of the two-part holder, such as to form a loop for placing the ice prod set around the neck of a bearer, and a second longer safety line is securely fastened to the handgrip of each ice prod and to the holder. Each of the handgrips incorporates a hollow or cavity in which the second longer line can be stowed when the ice prods are carried in their respective holder parts. According to the invention the cavity has a part which extends axially within the handgrip of respective ice prods and merges with an opening provided in a lower outer wall-surface of respective handgrips. Each of the holder parts also has an elongated part which is intended to cover the opening in respective handgrips when the ice prods are placed in their respective holder parts.

4 Claims, 1 Drawing Sheet

A
B
N
E
S
W

SET OF ICE PRODS

The present invention relates to an ice-prod set comprising two ice prods, each of which comprises a handgrip having attached to one end thereof a metal spike which extends coaxially with the handgrip, and each of which prods is held detachably in a two-part prod holder; a first line which extends between respective part of the two-part holder such as to form a loop for placing the holder around the neck of a person bearing the prod set; and a second, longer line which is securely fastened to the handgrip of each ice prod and to the holder, and each of which handgrips includes a cavity in which the second line is intended to be kept when the ice prods are not in use and supported in respective holder parts.

Several kinds of ice prods are known to the art. A common requirement of all ice prods is that they can be reached and made ready for use quickly and easily, should the bearer fall through the ice, e.g., of a frozen lake and into the water beneath the ice. The ice prods should also be configured or adapted in a manner to ensure that they will not be lost irretrievably while working up onto body-weight sustainable parts of the ice.

It is well known that the body temperature of a person in ice-cold water will fall rapidly and that his/her ability to move is swiftly impaired to a dangerous extent. Consequently, each second taken to prepare the ice prods for use will detract from the possibility of saving oneself and of survival. Two solutions are known to this requirement of enabling the ice prods to be brought to an in-use position quickly and of ensuring that the ice prods will not be lost irretrievably when scrambling for safe ice. According to one known solution, each ice prod is firmly clamped to the hand of the wearer, e.g. in the manner illustrated and described in Swedish Patent Specification Nos. 24 918 and 50 724. This solution is uncomfortable to the wearer, however, and is impracticable during the time when no emergency exists.

The most common solution is one in which the ice prods are either kept loosely in a suitable pocket or in a holder hung around the neck of the wearer. This does not always ensure, however, that the ice prods can be brought quickly to a ready-for-use position. In order to prevent the ice prods from being lost irretrievably in an emergency situation, this solution suggests that the ice prods are connected to the wearer, e.g. to an ice-prod holder, either directly or indirectly with the aid of a safety connection, e.g. a safety line or cord. Examples of this solution are found described in Swedish Patent Specifications Nos. 3159, 7501129-6 and 7608020-9. The cord connecting the ice prods to the bearer must be capable of being stored away in a manner which will ensure that the cords will not tangle or knot together when releasing the ice prods from the holder. The solution proposed in Swedish Patent Specification No. 7501129-6 requires the cord, or line, to be coiled externally around a prod sleeve connected to the prod holder or prod attachment. According to another variant the cord is instead wound around the lower part of the handgrip of an ice prod. Because the user is obliged to grip around the cord when releasing the ice prod, it is difficult to unwind the cord. The cord is also liable to fasten to the spike of the prod, when reaching forward to impale the prod into the ice.

Another solution to the problem of storing the cord in a favourable and safe manner is described in Swedish Patent Specification No. 7608020-9. This solution requires the safety line to have the form of a helically wound elastic cord similar to the helically coiled extensible leads used with telephones, electric kettles, etc. The helically coiled safety line is attached to the bottom of a blind bore which extends axially along the whole length of the handgrip and opens out at the rear end of the handgrip. It is intended that the intrinsic elasticity of the line will ensure that the major part of the line will be held within the handgrip when the ice prod is placed in the prod holder. The drawback with this solution, however, is that it is difficult to provide a safety line which has sufficient retracting force to ensure that it will be held inserted in the handgrip and not shaken loose therefrom or to slide therefrom under its own weight and subsequently tangle or bunch up. The line which has the smallest ability required to hold itself coiled within the handgrip when the prods are held in the prod holder will either present an excessive resistance when the prods are used and extended outwardly from the body or cannot be accommodated reasonably in the handgrips. Another disadvantage with this solution is that, compared with a conventional safety cord or line, a helically wound elastic cord is expensive. Furthermore, such cords are normally encased in a plastic sheath, which is liable to become brittle at the low temperatures in which the ice prods are used. Another drawback is that the large cavity required to accommodate the helically wound cord impairs the buoyancy of the remaining part of the ice prod. A sinking ice prod is difficult to grasp by a person placed in emergency conditions.

A common drawback with all known ice-prod constructions resides in the risk of the safety cord or line freezing and therewith rendering it difficult to release and use the ice prod. This is because the cord or line of the known solutions is exposed to snow, water splashes from wet ice and the moist breath of the bearer when the ice prods are worn close to the throat. The construction proposed in Swedish Specification No. 7608020-9 also has the drawback that wet snow is liable to enter the cavity accommodating the helical, extensible line and form an ice plug in the cavity.

It is essential that a person who has fallen into ice-cold water is able to summon assistance. This can be done with the aid of a whistle. Consequently, it is usual for people who venture onto unsafe ice to carry a whistle on a piece of string around their necks. Swedish Patent Specification No. 7501129-6 describes an integrated whistle and ice-prod set. A person who has fallen into ice-cold water, however will often find it difficult to find the whistle and move it quickly to his/her mouth, particularly since the person must simultaneously remove the ice prods from the holder. This problem is often accentuated by the fact that the whistle will sink in the water. When the whistle forms a separate part of the safety equipment used, there is also a risk that the whistle will be forgotten, and left behind.

The compass is another important component part of the safety equipment. A loose compass is often included. It is often sufficient to include a simple compass which will indicate an approximate direction, to avoid losing ones way in poor visibility, e.g. in heavy snow falls or in fog.

The object of the present invention is to provide an improved set of ice prods.

A further object of the invention is to provide an ice prod which is not encumbered with the disadvantages and drawbacks of known ice prods.

Another object of the invention is to provide an ice prod arrangement in which a cavity housing a safety cord is kept covered when the ice prod is held in a holder intended therefor.

Accordingly, this invention consists in an ice-prod set comprising two ice prods, each of which comprises a handgrip having attached to one end thereof a metal spike which extends coaxially with the handgrip and each of which prods is held detachably in a two-part prod holder; a first line or cord which extends between respective parts of the two-part holder such as to form a loop for placing the ice-prod set around the neck of a bearer; and a second, longer line or cord which is securely fastened to the handgrip of each ice prod and to the holder, and where each handgrip incorporates a cavity for housing the second line or cord when the ice prods are not in use, characterized in that the cavity has an elongated part which extends axially within its associated ice prod and merges with an opening formed in a lower outer wall-surface of the handgrip, and in that each of the holder parts has an elongated portion which is intended to close the opening in respective handgrips when the ice prods are placed in respective holder parts.

Thus, because the second, longer safety cord is housed in a cavity which extends axially within the handgrip and which is closed by a part of the holder when the ice prods are inserted into their respective holder parts, the risk that the cord will slide inadvertently from the handgrip and tangle with the ice prods is eliminated, as is also the risk of water and wet snow entering the cavity when the ice prods are carried in the holder. The cord, or line, is inserted into the cavity, by simply winding the cord around a finger an slipping the thus wound cord into the cavity, through the opening in the wall of the handgrip.

According to one embodiment of the invention, the set of ice prods also includes a whistle which will float horizontally, in a position in which the whistle can be readily grasped by a person in an emergency.

The set of ice prods also conveniently includes a simple compass which is attached permanently to the ice prod holder. Because the compass is made a permanent part of the set, there is no risk that the compass will be forgotten, or left behind.

According to one variant of the inventive ice prods, the handgrip also incorporates internally a hollow which is filled with a material which enhances the buoyancy of the handgrip.

So that the invention will be more readily understood and further features thereof made apparent, exemplifying embodiments of the invention will now be described in more detail with reference to the accompanying drawings, in which FIG. 1 illustrates a set of two ice prods, in which each prod is detachably carried in a holder, and in which the ice prods are shown in their ready-for-use position in broken lines;

DESCRIPTION OF A PREFERRED EMBODIMENT

Figures 1, 2, 3, 4, 5:
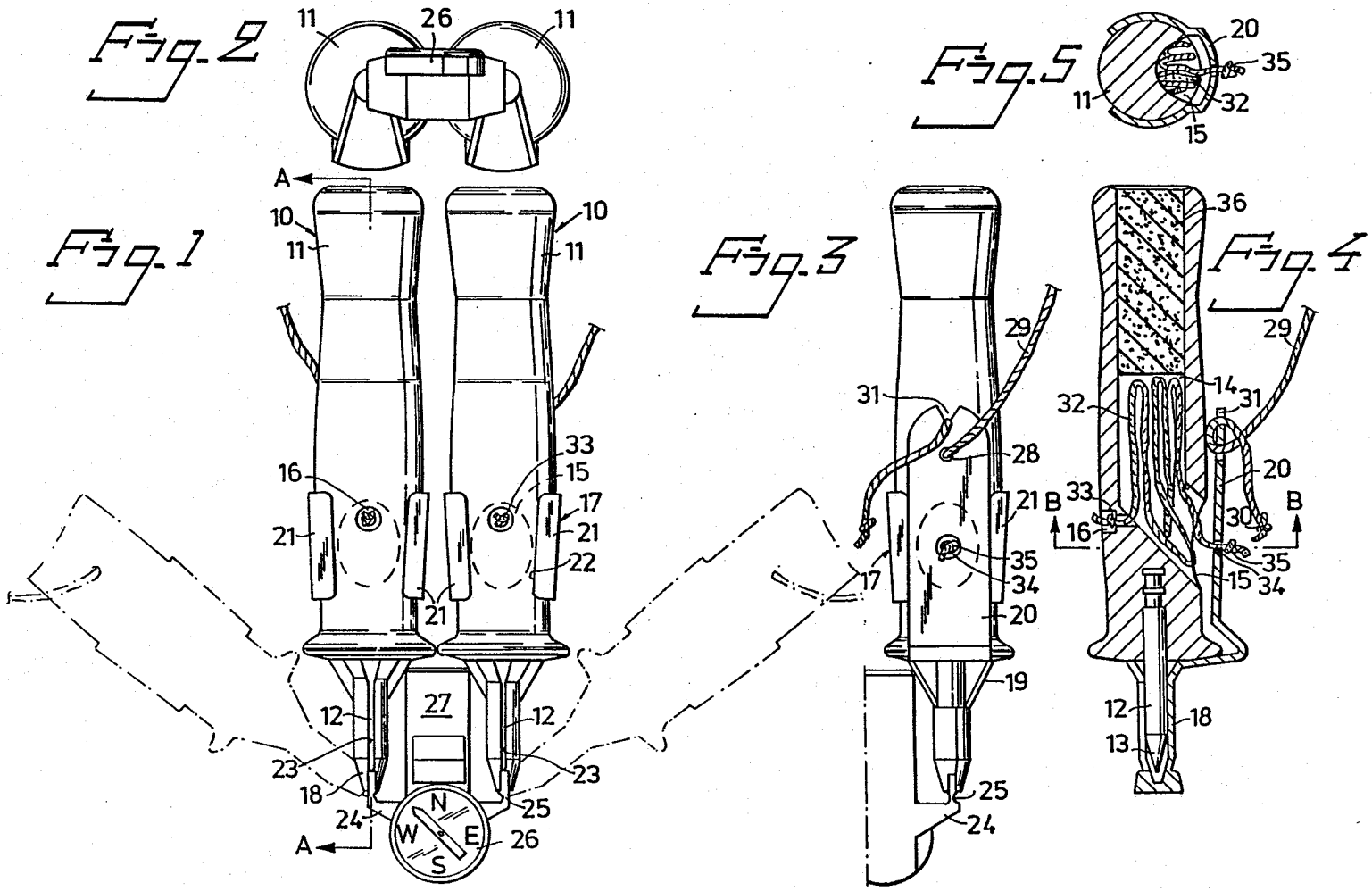
FIG. 2 is a view of the ice prods shown in FIG. 1, from beneath.
FIG. 3 is a rear view of an ice prod.
FIG. 4 is a sectional view taken on the line A—A in FIG. 1.
FIG. 5 is a sectional view taken on the line B—B in FIG. 4.

The set of ice prods illustrated in the drawings comprises two mutually identical ice prods generally referenced 10, each comprising a substantially cylindrical handgrip 11, which is preferably made of a buoyant material. Extending coaxially with the handgrip, from one end thereof, is a metallic spike 12, having a pointed end 13. The spike 12 may be permanently attached to the handgrip 11, or detachably connected thereto.

In accordance with the invention, each handgrip 11 has provided therein an internal cavity 14 which extends axially within the handgrip and merges with a relatively large opening 15 located in the lower half of respective handgrips. The axially extending cavity 14 also communicates with a further opening 16 formed in the wall of the handgrip opposite the first mentioned opening 15. The opening 16 is much smaller than the opening 15. In the case of the illustrated exemplifying embodiment the cavity 14 extends along the greater part of the handgrip and also incorporates a material 36 which enhances the buoyancy of the handgrip and thus also the ice prod.

Each of the aforedescribed ice prods 10 is intended to be carried by and to co-act sealingly with a holder or attachment hereinafter described.

The holder, or attachment, comprises two mutually identical holder parts, generally referenced 17 in the drawing. Each holder part comprises a conical portion 18 whose axial extension is somewhat greater than the length of the visible part of the metallic spike 12, or at least substantially of the same length as said part, such as to extend beyond the pointed end of the spike when the ice prod is carried in said holder part. The conical portion 18 is joined by a bridge 19 with an elongated portion 20 whose length is such that the upper end of said portion will lie at least in register with the upper edge of the opening 15, and preferably extends beyond said upper edge. The width of the elongated portion 20 is at least equal to the width or diameter of the opening 15, and is preferably slightly wider than the opening. The elongated portion 20 is provided at some location along its length with two essentially arcuate tongues 21 which curve towards one another and the mutually facing ends of which define therebetween a space 22. Each such holder part 17 is preferably constructed from a springy synthetic material, such that the tongues 21 obtain a certain degree of elastic resilience. The conical part 18 is preferably provided with a narrow slot 23 which extends axially along the greater part of the length of said part.

The two aforedescribed holder parts 17 of the ice-prod holder are connected indirectly to one another via a bridging element 24, which enables the holder parts 17 to be moved laterally apart about a respective hinge point 25 (as illustrated in ghost lines in FIG. 1).

The end of respective bridge elements 24 located opposite the pivot point 25 is firmly connected to the casing of a small compass 26, which is positioned essentially in a lower horizontal plane than that taken by the conical part 18. The two holder parts 17 of the holder or attachment will thus extend parallel and in line with one another. The upper part of the compass casing 26 is firmly connected to a whistle 27.

The aforedescribed holder is intended to support detachably an ice prod 10 in each holder part 17. The metallic spikes 12 of respective ice prods are inserted into the conical part 18, this insertion being facilitated by the axially extending slot 23. The handgrips 11 are then pushed in between the pairs of tongue-like elements 21 of respective holder parts 17, the resiliency of the tongues enabling them to be parted and then to snap around the handgrip 11. The ice prods are removed from the holder in the reverse manner.

The aforedescribed ice prod set comprising two ice prods 10 and two holder parts 17 also includes means which will ensure that the ice prods will not be lost irretrievably. Thus, the upper part of the elongated, axially extending part 20 of respective holder parts 17 is provided with a through-passing hole, referenced 28 in FIG. 3, through which one end of a thin cord or line 29 is passed and secured against withdrawal through the hole, e.g., by tying a knot 30. This cord or line 29 thus forms a loop, the size of which can be adjusted, e.g., through the medium of a notch 31 formed in the upper edge of the part 20. The loop formed by the cord 29 is hung around the neck of the bearer, thereby ensuring that the ice prods carried in the holder parts 17 will not be lost unintentionally.

For the purpose of ensuring that the ice prods 10 will not be lost irretrievably when removed from their respective holder parts and to ensure that the prods can be easily handled, a second relatively long cord or line 32 is passed through the opening 16 in respective handgrips 11 and secured against withdrawal through said hole by a knot 33. When the ice prods are not being used, the cord 32 is packed loosely in the cavity 14 and the opposite end of the cord 32 extends out through the larger opening 15 in the wall of the respective holder part and through a further hole 34 provided in the holder part 17 approximately in register with the opening 15. The cord or line 32 is secured against withdrawal, e.g., by a knot 35. This second cord 32 can thus be considered to secure respective ice prods 10 one to the other and also to respective holder parts 17. Since respective holder parts are firmly secured to the person carrying the ice-prod set, in the aforedescribed manner, the set forms an integrated unit which cannot be lost when worn around the neck. Since, when the ice prods 10 are carried in their respective holder parts, the elongated portion 20 of respective holder parts 11 will close the opening 15 of the internal cavity 14, the cord or line 32 stowed away in the cavity is essentially protected against contact with moisture and water, and therewith subsequent ice formations, and is also prevented from sliding out of the cavity until the ice prods are removed from the holder parts.

As a result of this arrangement, the ice prods are constantly maintained ready for use, irrespective of weather conditions.

When the ice prods 10 are removed from their respective holder parts 17, for instance in an emergency, the opening 15 is exposed and the cord or line 32 is able to run out. The length of the cord 32 is preferably at least equal to the length of an arm of the person carrying the ice prod set, so as to provide maximum reach.

It has been mentioned earlier that the handgrips 11 of respective ice prods 10 shall be made of a material which enables the prods to float in water. As beforementioned, in the case of the illustrated embodiment the internal cavity or hollow of the handgrip 11 is partially filled with a buoyancy enhancing material 36, such as a closed cell expanded material. Because the holder or attachment, i.e. the holder parts 17, are hung around the neck of the bearer, the bearer is able to reach the whistle 27 in order to summon assistance, without needing to use his hands.

A unique feature of the inventive ice-prod set resides in the embodiment of the compass 26, which will enable a person who has lost his way while crossing large frozen lakes, etc., to find his way, without needing to fumble for a pocket carried compass for example.

The embodiments of the invention in which an exclusive property or privilege is claimed are defined as follows:

1. An ice prod set comprising two ice prods each of which comprises a handgrip having attached to one end thereof a metal spike which extends coaxially with the handgrip and each of which prods is held detachably in a two-part prod holder; a first line which extends between respective part of the two-part holder such as to form a loop for placing the ice prod set around the neck of a bearer; and a second longer line which is securely fastened to the handgrip of each ice prod and to the holder, and each of which handgrips incorporates a hollow or cavity for storing the second line when the ice prods are not in use, characterized in that the cavity has a part which extends axially within the handgrip of respective ice prods and merges with an opening provided in a lower outer wall-surface of respective handgrips; and in that each of the holder parts has an elongated part which is intended to cover the opening in respective handgrips when the ice prods are placed in their respective holder parts.

2. An ice prod set comprising two ice prods according to claim 1, characterized in that the holder parts are connected to one another indirectly by a bridging pivot element which enables the holder parts to be swung away from one another; and in that the bridging pivot element incorporates a compass and a whistle positioned between the pivotally connected holder parts.

3. An ice prod set comprising two ice prods according to claim 1, characterized in that the elongated, axially extending part of respective holder parts is intended to abut or lie closely adjacent to respective handgrips.

4. An ice prod set according to claim 1, characterized in that the internal cavity or hollow extends along a considerable length of its respective handgrip and accommodates a buoyancy enhancing material.

* * * * *